US008641227B1

(12) United States Patent
Yeh

(10) Patent No.: US 8,641,227 B1
(45) Date of Patent: Feb. 4, 2014

(54) ANTI-PRESSING APPARATUS FOR FLASHLIGHT

(75) Inventor: Hsueh-Chu Yeh, Tainan (TW)

(73) Assignee: Shih-Hao Wang, Tainan (TW)

( * ) Notice: Subject to any disclaimer, the term of this patent is extended or adjusted under 35 U.S.C. 154(b) by 0 days.

(21) Appl. No.: 13/589,279

(22) Filed: Aug. 20, 2012

(51) Int. Cl.
*F21L 4/04* (2006.01)
*F21V 25/12* (2006.01)
*F21V 23/04* (2006.01)

(52) U.S. Cl.
USPC ..... 362/206; 362/204; 362/205; 362/165; 362/394

(58) Field of Classification Search
USPC ..... 362/204–206, 165, 394
See application file for complete search history.

(56) References Cited

U.S. PATENT DOCUMENTS

| | | | | |
|---|---|---|---|---|
| 6,092,910 | A * | 7/2000 | Sung | 362/206 |
| 6,609,810 | B2 * | 8/2003 | Kim | 362/110 |
| 6,742,911 | B1 * | 6/2004 | Chen | 362/206 |
| 7,281,814 | B2 * | 10/2007 | Sheen | 362/183 |
| 7,959,317 | B2 * | 6/2011 | Spartano et al. | 362/203 |
| 8,110,760 | B2 * | 2/2012 | Sharrah et al. | 200/60 |
| 2005/0068766 | A1 * | 3/2005 | Sharrah et al. | 362/187 |
| 2009/0080183 | A1 * | 3/2009 | Opolka | 362/205 |
| 2010/0165613 | A1 * | 7/2010 | Rorick | 362/206 |
| 2010/0315808 | A1 * | 12/2010 | Yeh | 362/205 |
| 2011/0103048 | A1 * | 5/2011 | Kennedy et al. | 362/205 |
| 2011/0176296 | A1 * | 7/2011 | Rorick | 362/206 |

* cited by examiner

*Primary Examiner* — Jong-Suk (James) Lee
*Assistant Examiner* — Bryon T Gyllstrom
(74) *Attorney, Agent, or Firm* — Alan Kamrath; Kamrath IP Law Firm, PA

(57) ABSTRACT

The present invention provides an anti-pressing apparatus for flashlight, comprising a space provided on one end of the flashlight, a dialing piece inserted into a slot adjacent to the space, a pressing piece provided on a perforation having the dialing piece inserted therein, a restraining piece corresponding to an outer end of the pressing piece on the central perforation of the flashlight in order to restrain the pressing piece to move upward and downward only; whereby during use of the anti-pressing assembly of the flashlight, only the push portion of the dialing pieces is required to be dialed to another side to drive the blocker of the dialing piece to rotate to a lower position underneath the protruding section of the pressing piece in order to restrain the downward movement of the pressing piece and accidental pressing down on the power of the flashing can be prevented.

4 Claims, 9 Drawing Sheets

ANTI-PRESSING APPARATUS FOR FLASHLIGHT

BACKGROUND OF THE INVENTION

1. Technical Field

The present invention is related to an anti-pressing apparatus for flashlight and is mainly to provide a positioning restrain to the pressing piece for controlling the switch-on or switch-off of the power of the flashlight when the flashlight is not in use such that the switch-on of the power of the flashlight can be prevented when the pressing piece is accidentally pressed.

2. Description of Related Art

According to known flashlights with the function of illumination, the dialing switch of the power of flashlights can be generally categorized as: the configuration of having one press for switch-on and another press again for switch-off, the configuration of having one push to one side for switch-on and another push to the other side for switch-off and others, such that the illumination from the flashlight is switched on or off according to the power on or off of the flashlight. However, there is no design or configuration provided to restrain the dialing on or off of the power, which causes the power being accidentally switched on by users during unintentional uses of the flashlight and leads to the wasting of power provided at the internal of the flashlight.

SUMMARY OF THE INVENTION

The present invention is an improvement to a flashlight for illumination purposes such that accidental switching on of the power of the flashlight not in use can be prevented, and a positioning restrain is provided for a pressing piece used to switch on or off of the power of the flashlight to prevent accidental switching on of the power when the flashlight is not in use.

A primary objective of the present invention is related to an anti-pressing apparatus for flashlight as an anti-pressing assembly provided on one end of said flashlight to prevent accidental switch-on of power thereof, comprising a space formed on one end of a power controller pre-assembled on said flashlight, an indented slot adjacent to a side of said space and provided to receive a hollow dialing piece inserted therein, at least one sectional blocker extended inward at a circumference surrounding a central hole of said dialing piece, and a push portion formed on an outer circumference thereof; a pressing piece attached to said dialing piece and provided in a perforation adjacent to a top of said flashlight, a protruding section having a shape corresponding to said sectional blocker of said dialing piece and provided on a lateral circumference of said pressing piece, and cut-outs provided on two correspondingly predefined portions of said pressing piece such that two supporting arms of a hollow restraining piece is provided correspondingly to said central perforation of said flashlight and protruding ribs provided on an inner circumference of said hollow retaining piece pass through said two cut-outs of said pressing piece and such that said pressing piece is restrained to move in upward and downward pressing movements only; whereby during use of said anti-pressing assembly provided on said one end of said flashlight, only said push portion provided on one end of said dialing piece is being dialed toward another side to drive said blocker on said inner circumference of said dialing piece to rotate to a lower position underneath said protruding section of said pressing piece such that said pressing piece is restrained from said downward pressing movement to prevent accidental pressing of power of said flashlight.

A second objective of the present invention is to provide a groove on an end surface of said push portion on said outer circumference of said dialing piece of said anti-pressing assembly on said one end of said flashlight, and said groove corresponds to a protrusion extended on a corresponding circumference of said flashlight such that during a rotational movement thereof, a positioning limitation thereof is predefined.

A third objective of the present invention is to provide protrusions on said two ends of outer portions of said two supporting arms extended from said restraining piece of said anti-pressing assembly on said one end of said flashlight, and said protrusions correspond to two notches predefined on said central perforation of said flashlight and are locked therein.

A fourth objective of the present invention is to provide a sectional protrusion on two corresponding sides on an inner circumference of said space of said anti-pressing assembly on said one end of said flashlight and to form a press-fit at a contacting portion thereof as said dialing piece is inserted.

DESCRIPTION OF EMBODIMENTS OF THE INVENTION

Figure 1:
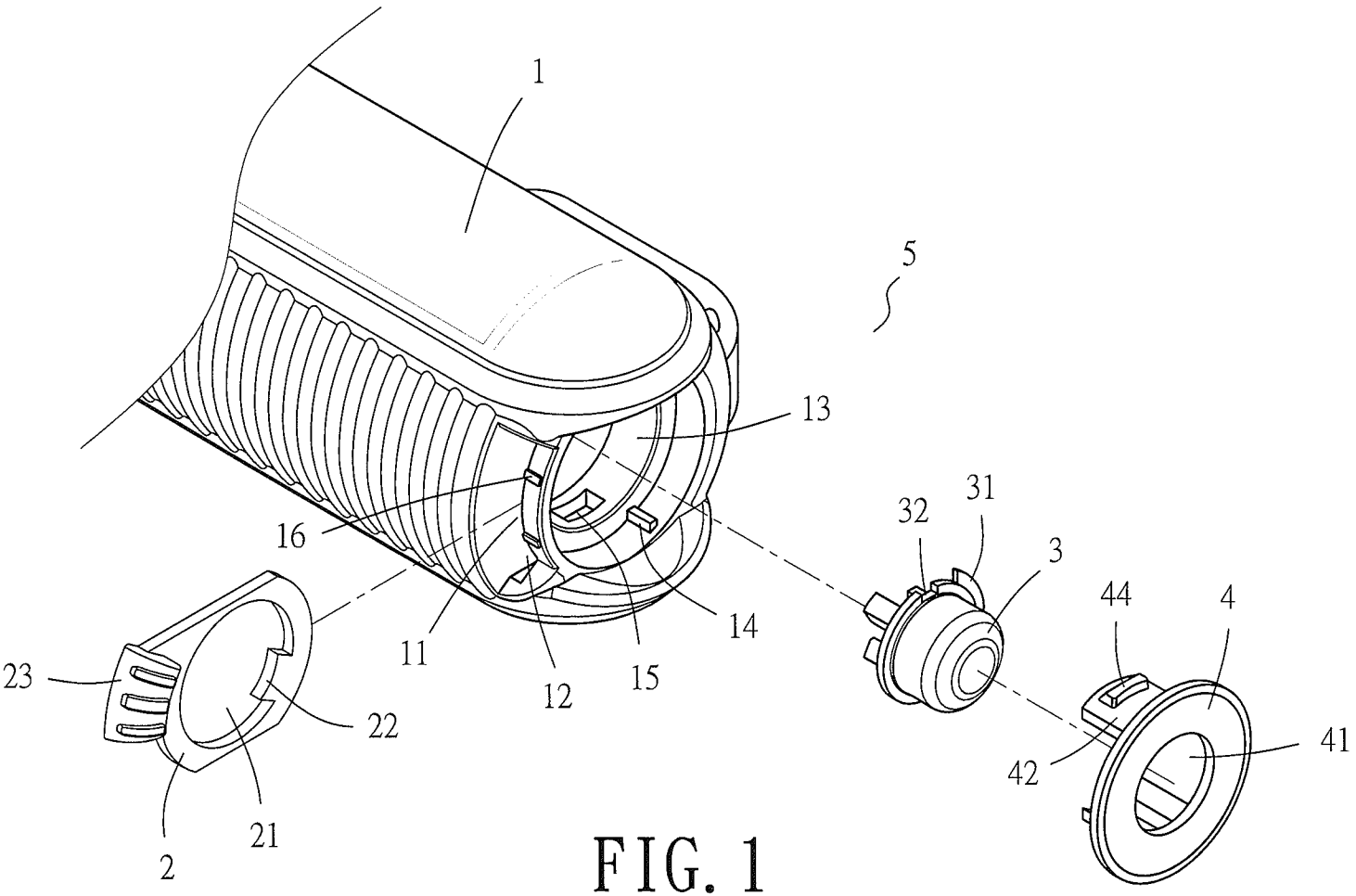
FIG. 1 is an exploded view of the components of the anti-pressing assembly for flashlight of the present invention.
Figure 2:
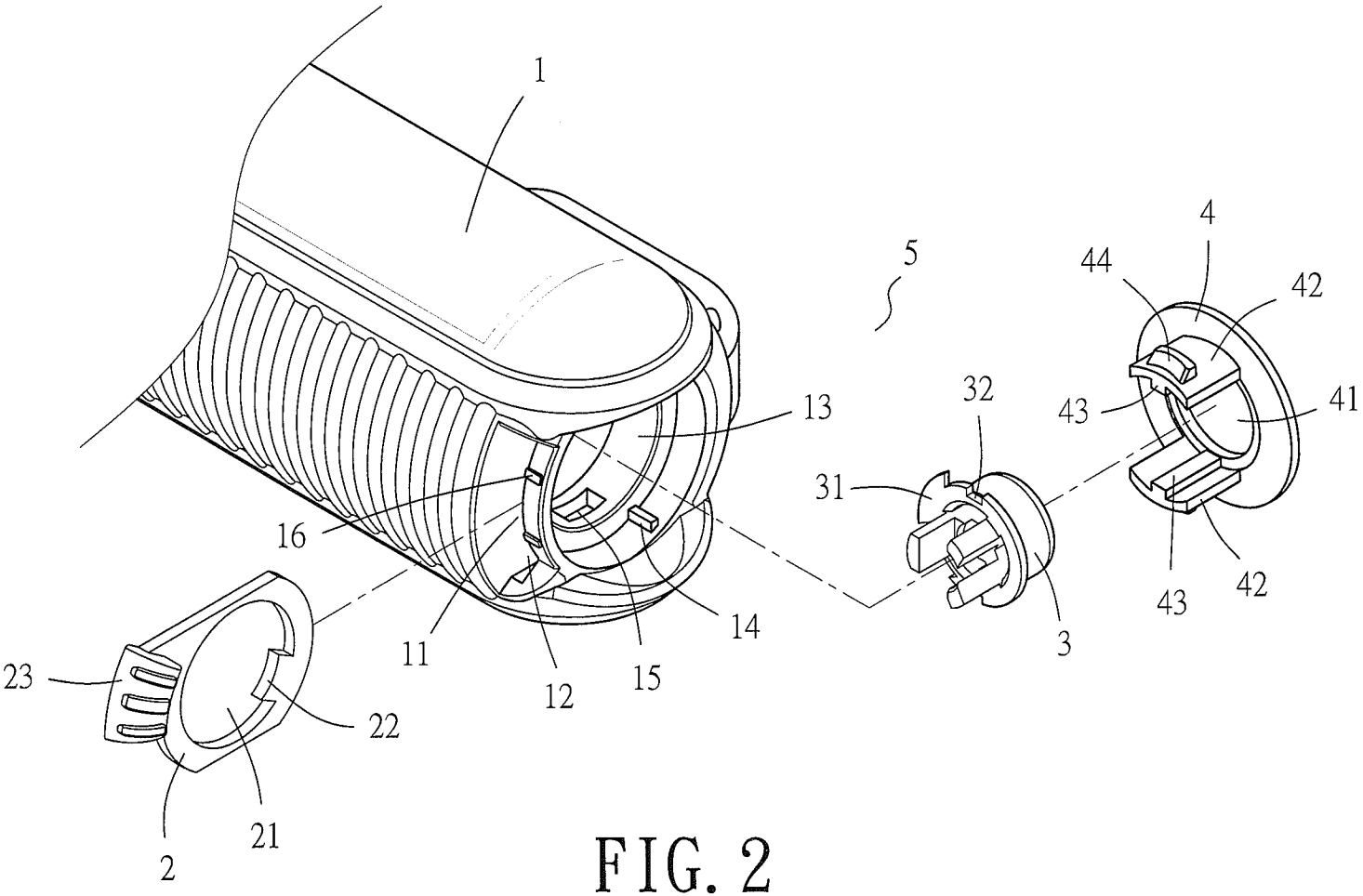
FIG. 2 is another directional exploded view of the anti-pressing assembly for flashlight of the present invention.

As shown in FIGS. 1 and 2, the anti-pressing apparatus for flashlight of the present invention is provided as an anti-pressing assembly 5 on one end of a flashlight 1 to prevent accidental switch-on of the power thereof, comprises a flashlight 1, a dialing piece 2, a pressing piece 3 and a restraining piece 4; wherein:

A flashlight 1 comprises a space 11 formed on one end of a pre-assembled power controller thereof, an indented slot 12 adjacent to a side of said space 11, a sectional protrusion 14 provided on two corresponding sides of an inner circumference of a central perforation 13 on said one end of said flashlight 1, two notches 15 provided adjacent to an inner section of said central perforation 13 having said two protrusions 14, and at least one unit or more than one unit of protrusions 16 extended outward from an outer circumference of the end into which the dialing piece 2 can be correspondingly inserted on the flashlight 1.

A dialing piece 2 is provided according to the central perforation 13 of the flashlight 1 and the space 11 extended inward on a side thereof. The center of the dialing piece 2 is provided with a hole 21 and a section or more than one section of blocker 22 extended inward at an inner circumference of the hole 21. In addition, a push portion 23 is formed on an outer circumference of the dialing piece 2 and a groove 24 is provided an end surface of said push portion 23 as shown in FIG. 4.

A pressing piece 3 is provided according to the configuration or shape of the central perforation 13 and dialing piece 2 of the flashlight 1. A protruding section 31 is formed on a lateral circumference of said pressing piece 3 (the protruding section is configured according to the shape and number of the blocker 22 of the dialing piece 2). In addition, cut-outs 32 are provided on two correspondingly predefined portions of said pressing piece 3.

A restraining piece 4 is provided according to the top circumference of the central perforation 13 of the flashlight 1 to restrain the directional rotation of the pressing piece 3. A hole 41 is provided on the center of the restraining piece 4 to allow the pressing piece 3 to move toward another end thereof and two supporting arms 42 extend inward from an end of the restraining piece 4; also, protruding ribs 43 are provided on the inner circumference of the two supporting arms 42, as shown in FIG. 2. In addition, a protrusion 44 is provided one an end adjacent to an outer portion of the two supporting arms 42 of the restraining piece 4.

Figure 3:
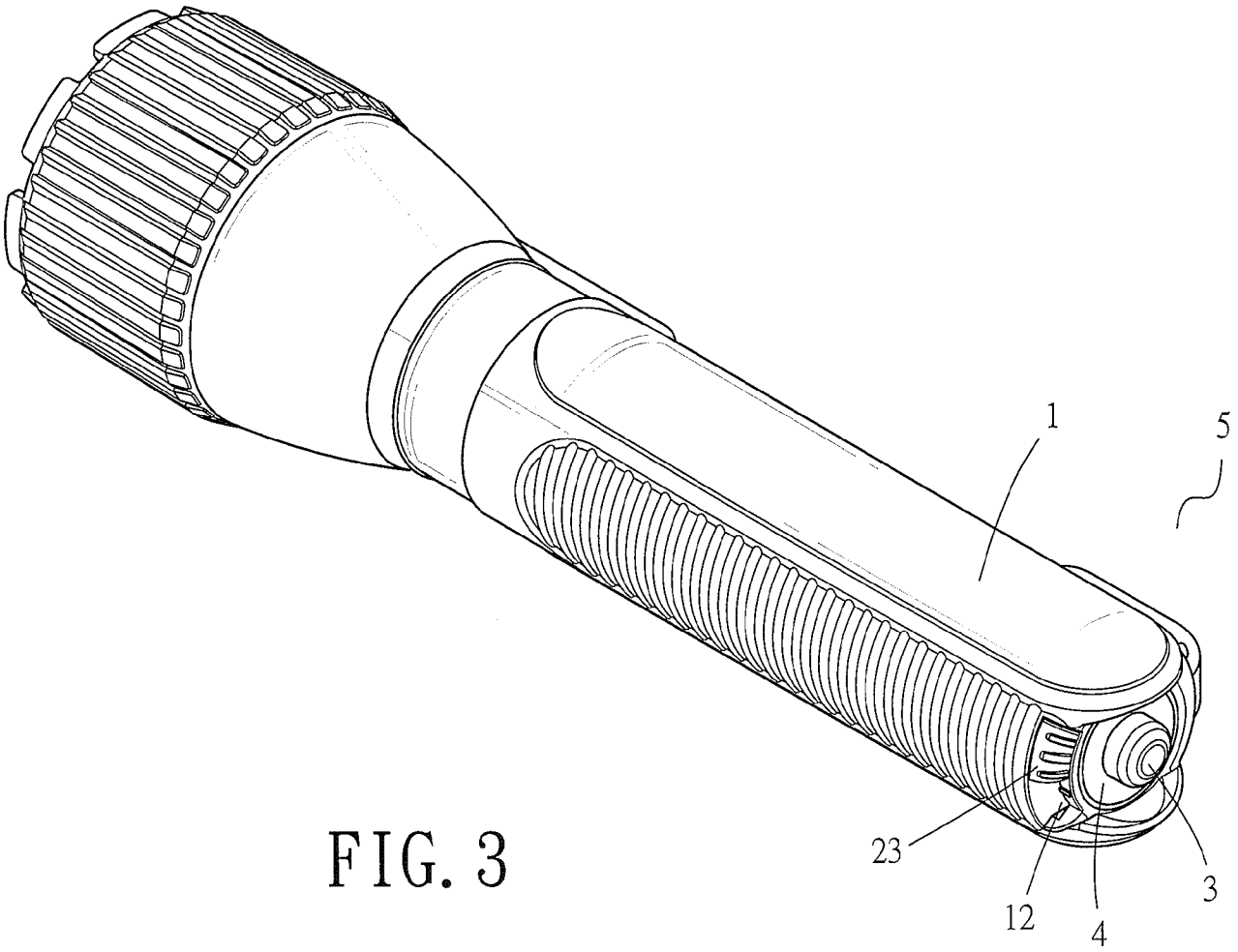
FIG. 3 is an assembled outer appearance view of the anti-pressing assembly for flashlight of the present invention.
Figure 4:
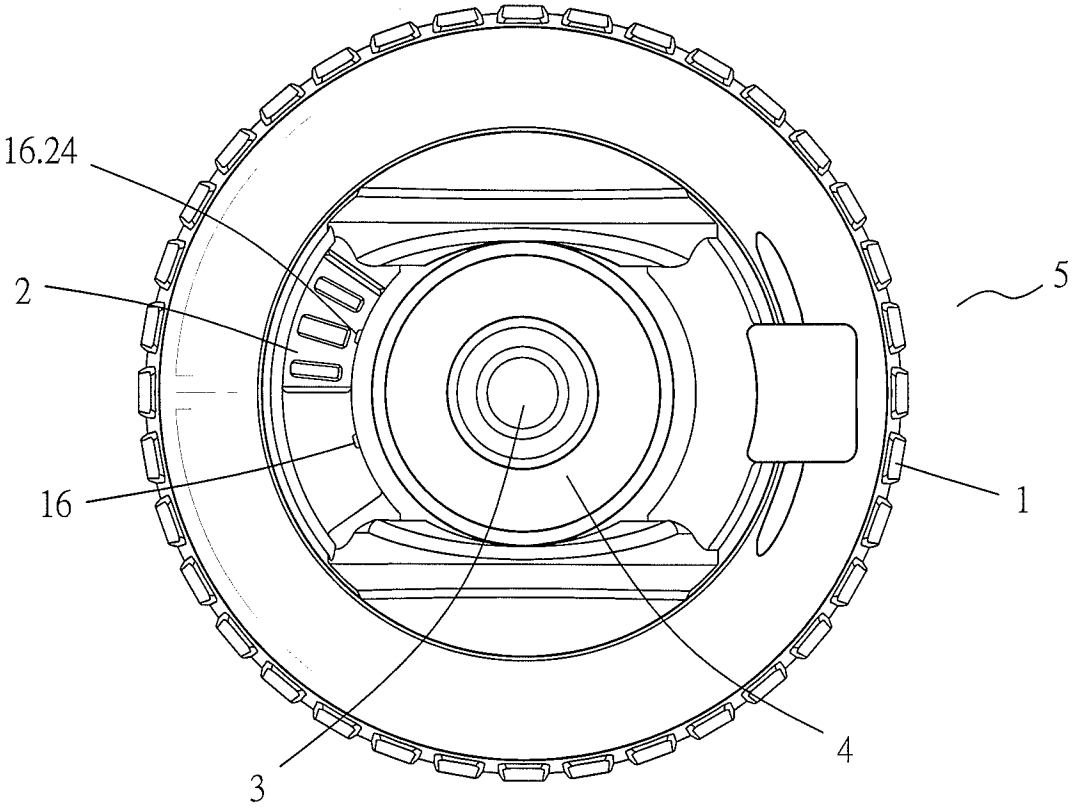
FIG. 4 is a rear view of the anti-pressing assembly of FIG. 3 in a pressable state.
Figure 6:
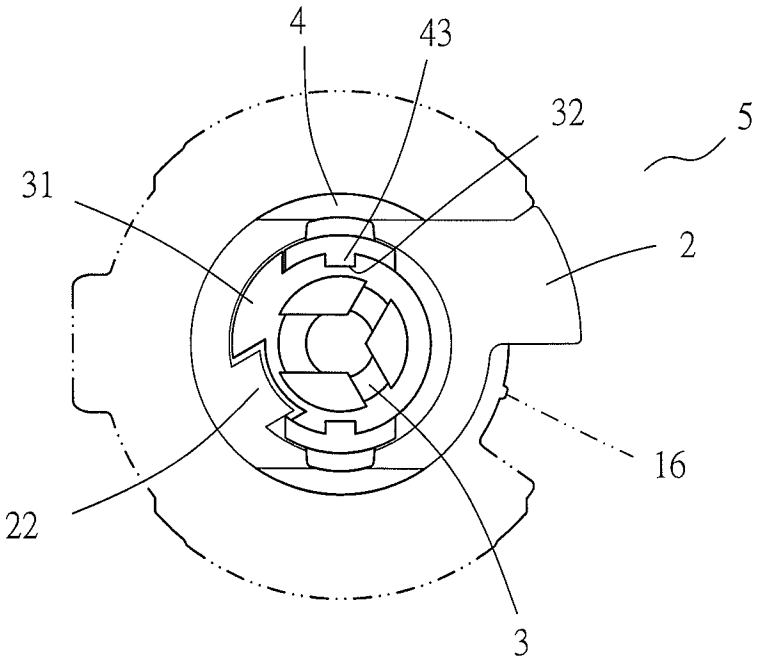
FIG. 6 is a sectional view taken along the line 60-60 in FIG. 5.

As shown in FIGS. 1, 2, 4 and 6, the assembly of the abovementioned dialing piece 2, pressing piece 3 and restraining piece 4 in the application end of the central perforation 13 of the flashlight 1 includes the following steps. First step: inserting the dialing piece 2 along and pass through the indented slot 12 into the space 11 on one end of the flashlight 1 such that the protrusions 14 on two sides of the space 11 of the flashlight 1 abut and form a press-fit at a contacting portion of the dialing piece 2 and the groove 24 on the inner surface of the push portion 23 on one end of the dialing piece 2 abuts the protrusions 16 on the corresponding circumference of the flashlight 1 as shown in FIG. 4. Second step: assembling the pressing piece 3 into the top adjacent perforation 13 having the dialing piece 2 inserted therein and the pressing piece 3 is positioned on an outer surface of the dialing piece 2 such that the dialing piece 2 can be moved smoothly along the space 11 of the flashlight 1. Third step: then assembling the two supporting arms 42 extended inward from the restraining piece 4 into the central perforation 13 of the flashlight 1 correspondingly such that two supporting arms 42 pass through the corresponding two cut-outs 32 of the pressing piece 3 along the protruding ribs 43 on the inner circumference thereof, as shown in FIG. 6, to restrain the pressing piece 3 to move in upward and downward pressing movements only, and such that the two supporting arms 42 of the restraining piece 4 adjacent to the outer portion of the protrusion 44 are locked into the two notches 15 of the central perforation 13 of the flashlight 1 in order to complete the assembly of the anti-pressing assembly 5 of the flashlight 1 as shown in FIG. 3.

Figure 5:
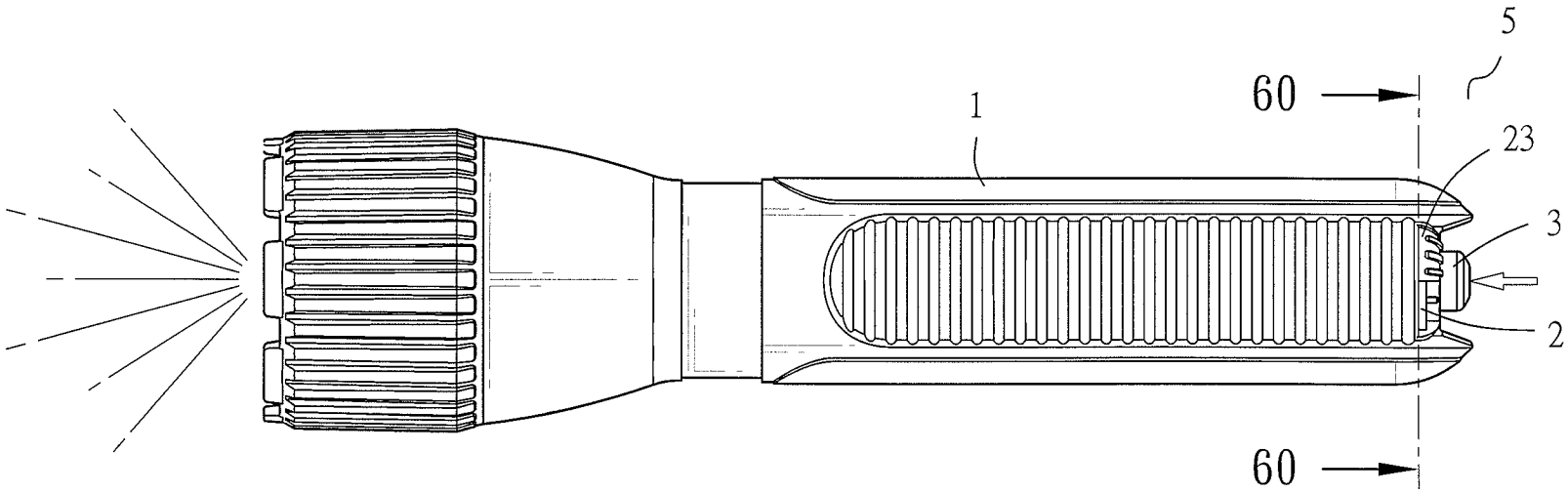
FIG. 5 is a side view of the flashlight of the present invention in a pressed state.

As shown in FIGS. 4 and 5, the switch-on of the anti-pressing assembly 5 provided on one end of the flashlight 1 for switching the power of the flashing under normal use includes the following. The dialing piece 2 is pushed to move toward one end via the push portion 23 along the outer circumference thereof to drive the sectional blocker 22 of the dialing piece 2 extended on the circumference of the central perforation 21 to be misaligned with the protruding section 31 on the circumference of the pressing piece 3 and to be in the state of unblocking, as shown in FIG. 6, and such that the user is required to press down on one end of the pressing piece 3, shown by the arrow in FIG. 5, to activate the conductive components in the internal of the flashlight 1 in order to switching on the power of the flashlight 1 and to activate the illumination of the lighting parts on the other end of the flashlight 1.

Figure 7:
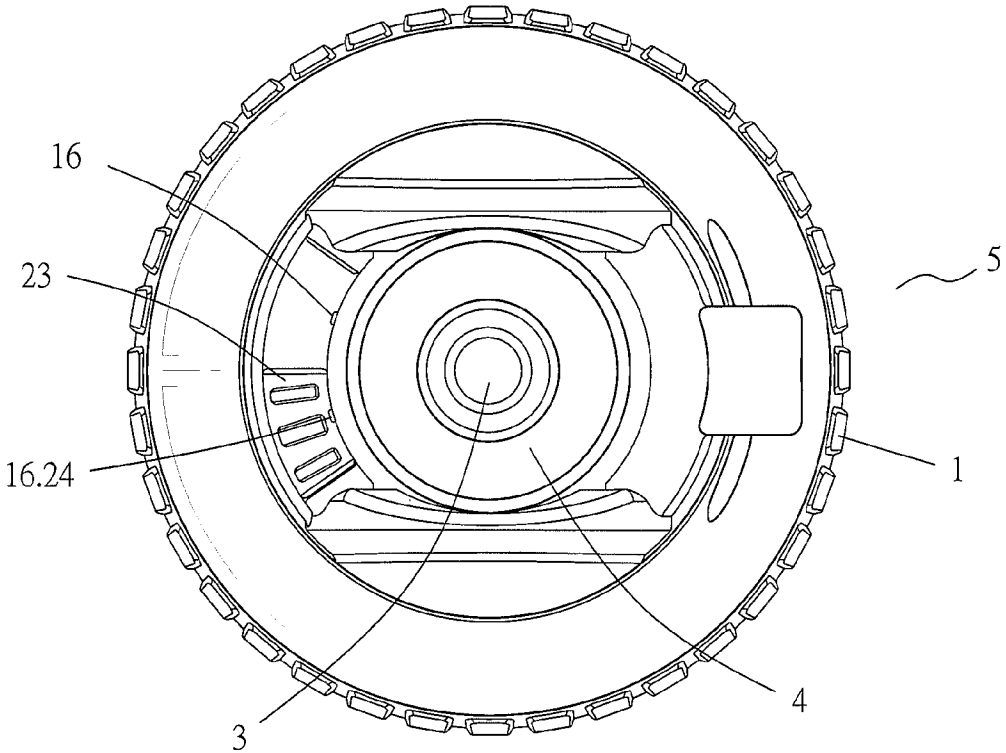
FIG. 7 is a rear view of the anti-pressing assembly of FIG. 3 in a non-pressable state.
Figure 8:
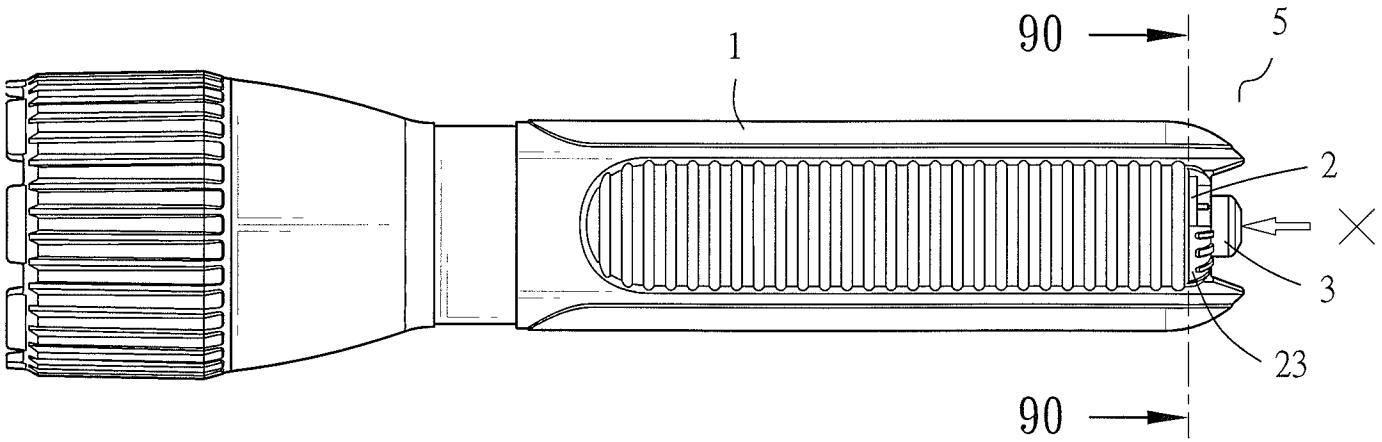
FIG. 8 is a side view of the flashlight of the present invention in a non-pressable state.
Figure 9:
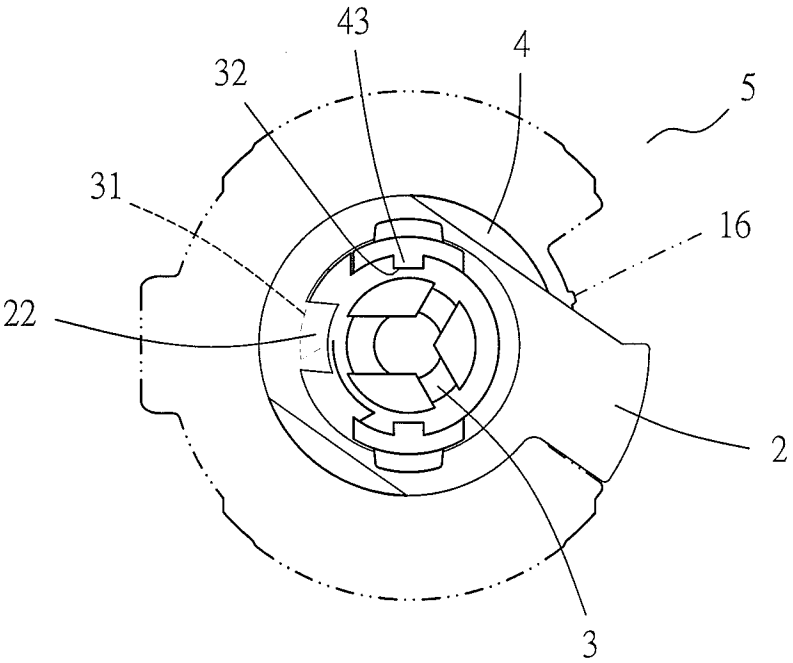
FIG. 9 is a sectional view taken along the line 90-90 in FIG. 8.

As shown in FIGS. 7 and 8, in order to prevent the accidental switch-on of the power of the flashlight 1 not in use, only the push portion 23 on one end of the dialing piece 2 needs to be dialed or pushed to the other side (as the push portion 23 on the outer side of the dialing piece 2 is rotated to a maximum degree, the groove 24 provided on an end surface would then be restrained in position by another protrusion 16 provided on a corresponding circumference of the flashlight 1) such that the sectional blocker 22 on the inner circumference of the dialing piece 2 rotates to a lower position underneath the protruding section 31 of the pressing piece 3, as shown in FIG. 9, and such that the pressing piece 3 is restrained from the downward pressing movement, as shown in FIG. 8, to prevent accidental pressing of power of said flashlight 1.

What is claimed is:

1. An anti-pressing apparatus for a flashlight, provided as an anti-pressing assembly on one end of said flashlight to prevent accidental switch-on of power thereof, comprising: a space formed on one end of a power controller pre-assembled on said flashlight, an indented slot adjacent to a side of said space and provided to receive a hollow dialing piece inserted therein, at least one sectional blocker extended inward at a circumference surrounding a central hole of said dialing piece, and a push portion formed on an outer circumference thereof; a pressing piece attached to said dialing piece and provided in a perforation adjacent to a top of said flashlight, a protruding section having a shape corresponding to said sectional blocker of said dialing piece and provided on a lateral circumference of said pressing piece, and cut-outs provided on two correspondingly predefined portions of said pressing piece such that two supporting arms of a hollow restraining piece are provided correspondingly to said central perforation of said flashlight and protruding ribs provided on an inner circumference of said hollow retaining piece pass through said two cut-outs of said pressing piece and such that said pressing piece is restrained to move in upward and downward pressing movements only; whereby during use of said anti-pressing assembly provided on said one end of said flashlight, only said push portion provided on one end of said dialing piece is being dialed toward another side to drive said blocker on said inner circumference of said dialing piece to rotate to a lower position underneath said protruding section of said pressing piece such that said pressing piece is restrained from said downward pressing movement to prevent accidental pressing of power of said flashlight.

2. The anti-pressing apparatus for flashlight as claimed in claim 1, wherein an end surface of said push portion on said outer circumference of said dialing piece of said anti-pressing assembly on said one end of said flashlight is provided with a groove, and said groove corresponds to a protrusion extended on a corresponding circumference of said flashlight such that during a rotational movement thereof, a positioning limitation thereof is predefined.

3. The anti-pressing apparatus for flashlight as claimed in claim 1, wherein two ends of outer portions of said two supporting arms extended from said restraining piece of said anti-pressing assembly on said one end of said flashlight are provided with protrusions, and said protrusions correspond to two notches predefined on said central perforation of said flashlight and are locked therein.

4. The anti-pressing apparatus for flashlight as claimed in claim 1, wherein two corresponding sides on an inner circumference of said space of said anti-pressing assembly on said one end of said flashlight are provided with a sectional protrusion to form a press-fit at a contacting portion thereof as said dialing piece is inserted.

* * * * *